United States Patent [19]

Ezzell

[11] Patent Number: 4,577,677

[45] Date of Patent: Mar. 25, 1986

[54] METHOD FOR CLEANING HEAT EXCHANGERS

[75] Inventor: Robert C. Ezzell, Teesside, Great Britain

[73] Assignee: Phillips Petroleum Company, Bartlesville, Okla.

[21] Appl. No.: 715,310

[22] Filed: Mar. 25, 1985

[30] Foreign Application Priority Data

Jan. 7, 1985 [GB] United Kingdom ..... 8500316

[51] Int. Cl.[4] ..... F28G 13/00

[52] U.S. Cl. ..... 165/1; 165/95; 165/143; 208/48 R

[58] Field of Search ..... 165/1, 95, 39, 40, 103, 165/84, 143, 144; 208/48 R

[56] References Cited

U.S. PATENT DOCUMENTS

| | | | |
|---|---|---|---|
| 2,945,799 | 7/1960 | Rees et al. | 208/48 |
| 2,947,522 | 8/1960 | Keller | 165/103 X |
| 2,953,514 | 9/1960 | Wilkins | 208/95 |
| 3,136,711 | 6/1964 | Glaser et al. | 208/37 |
| 3,405,054 | 10/1968 | Arkis et al. | 208/48 |
| 3,414,482 | 12/1968 | Folz | 203/2 |
| 3,546,097 | 12/1970 | Tupper | 208/48 |
| 3,627,746 | 12/1971 | Beals et al. | 260/94 |
| 3,818,975 | 6/1974 | Tokumitsu et al. | 165/95 X |
| 3,850,741 | 11/1974 | Callahan et al. | 204/48 |
| 4,509,589 | 4/1985 | Carlson et al. | 165/95 |

FOREIGN PATENT DOCUMENTS

| | | | |
|---|---|---|---|
| 849053 | 9/1960 | United Kingdom | 165/95 |
| 926510 | 5/1982 | U.S.S.R. | 165/95 |

OTHER PUBLICATIONS

Nelson–Petroleum Refinery Engineering–1936, pp. 574–575, McGraw–Hill Book Co. Inc.

*Primary Examiner*—Sheldon J. Richter
*Attorney, Agent, or Firm*—William R. Sharp

[57] ABSTRACT

A method of operating a heat exchange system of the type adapted to receive a hot fluid and a cool fluid therethrough accomplishes cleaning of the system by terminating cool fluid flow to a portion of the system. Both fluids are passed through the entire system for a period of time. Flow of the cool fluid is then terminated to a portion of the system while continuous flow of the hot fluid is maintained through the entire system. Thus, the operating temperature of the entire system is increased so as to melt wax and other deposits on surfaces in the system.

7 Claims, 5 Drawing Figures

METHOD FOR CLEANING HEAT EXCHANGERS

BACKGROUND OF THE INVENTION

This invention relates to a method of cleaning heat exchangers wherein various deposits are removed therefrom.

This invention is particularly suitable for use in the situation in which residual heat in processed (stabilized) crude oil is transmitted to raw (unsatabilized) crude oil through shell and tube heat exchangers. In such a system, processed or stabilized crude oil from a fractionation tower is transmitted typically to the shell side of a series of shell and tube heat exchangers. Unstabilized crude, typically at a lower temperature than the stabilized crude, is charged to the tube side of the exchangers. The residual heat from the stabilized crude is accordingly transmitted to the unstabilized crude flowing through the tube side of the exchangers. Therefore, the unstabilized crude is preheated before being charged to the fractionation tower for processing. Before being charged to the fractionation apparatus for processing, the preheated unstabilized crude is further heated by external means, e.g., a furnace. During the operation of the heat exchangers, the exchangers usually begin to foul through the deposition of carbonaceous materials (usually paraffin waxes) and other solid deposits such as salt. These deposits cause a lowering of the heat transfer coefficient of the exchangers, thus causing the crude furnace to consume more fuel to bring the unstabilized crude to an adequate temperature for efficient fractionation. This represents a waste of energy which could otherwise be conserved.

Prior methods of removing the above mentioned deposits include reversing the direction of flow of shell and tube side fluids through the exchangers. This method removes or melts much of the deposits in the end exchangers in the series, but usually fails to melt deposits in the middle exchangers and may merely transfer the deposits to another area in the exchanger series. In the past, various equipment has also been used to warm up the exchangers to melt deposits therein. This technique however is very expensive due to the equipment utilized and requires removing exchangers from service. Various solvents have also been utilized to remove deposits. These solvents are typically introduced into one side of the exchangers. Usually, however, these solvents can be very expensive, and the equipment necessary for manipulating and recycling the solvents can also be very expensive and time consuming to operate. Reference is made at this point to U.S. Pat. No. 3,850,741 of Callahan et al which discloses one particular method utilizing solvents wherein the tube side fluid of a shell and tube heat exchanger is displaced by a particular solvent. The solvent is allowed to remain in the tube side of the exchanger for a period of about 8 to 24 hours to remove the deposits accordingly. During this period, it is necessary to take the exchangers out of service, thus contributing to the inefficiency of the entire preheating process.

SUMMARY OF THE INVENTION

It is, therefore, an object of the present invention to provide a method of cleaning heat exchangers.

It is also an object of the present invention to provide a method of cleaning heat exchangers which is relatively inexpensive.

It is a further object of the present invention to provide a cleaning method which requires less down time of the exchangers than in prior methods.

It is yet another object of the invention to provide a cleaning method which requires little operator time or equipment to implement.

The above objects are realized in a method which utilizes a heat exchange system wherein a first fluid and a second fluid are concurrently passed therethrough. The first fluid is at a higher temperature than the second fluid upon entering the system, and heat is exchanged between the two fluids. Flow of second fluid through at least a portion of the system is terminated according to the present invention, while continuous flow of first fluid is maintained for a period of time. In contrast to above cited U.S. Pat. No. 3,850,741, no other fluids are introduced into the system during this step.

According to a preferred embodiment of the invention, a heat exchange system utilizing a plurality of shell and tube heat exchangers connected in series is employed. Hot stabilized crude is charged to the shell side of the exchangers and cold unstabilized crude is charged to the tube side of the exchangers. The exchangers may be divided up into two groups wherein unstabilized crude flow is terminated to one group so as to bypass that group. Accordingly, as will be explained in more detail below, the operating temperatures of at least some of the exchangers are increased to assist in melting wax and other deposits, thus increasing the heat transfer coefficient of the exchangers.

The above described method of the invention requires no special solvents or warming equipment as in prior methods. Thus, the present method is very inexpensive to implement. Also, an operator needs only to open and close selected valves, as will be described below, to bypass a selected group of exchangers. Consequently, very little operator time is required to implement the method. Furthermore, the method requires only a few hours in which only a portion of the system is effectively taken out of service before resuming full shell and tube side flow through the exchangers. It is emphasized, however, that hot first fluid, or shell side fluid in the preferred embodiment, flows through the exchangers at all times.

DESCRIPTION OF THE PREFERRED EMBODIMENTS

Figure 1:
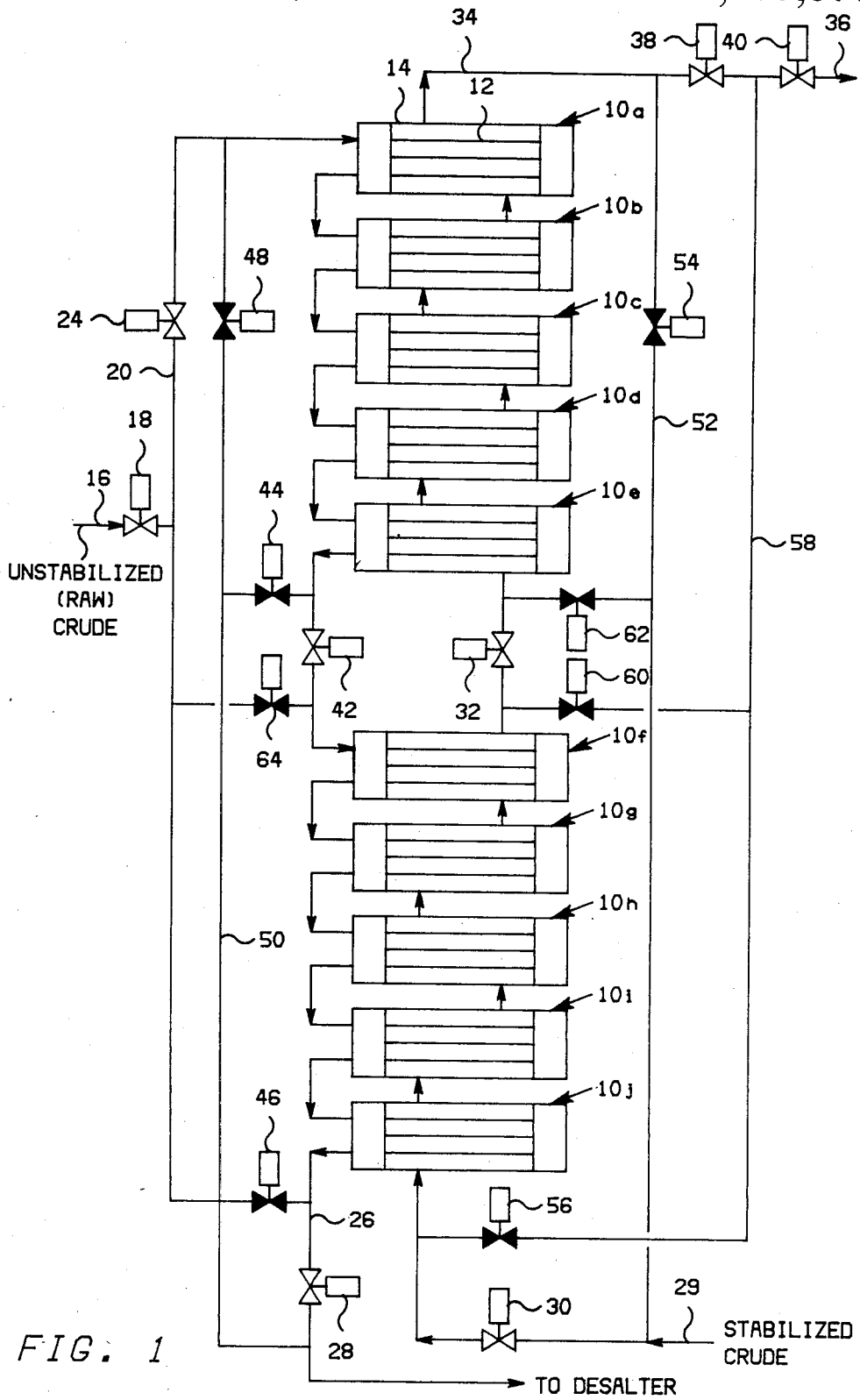
FIG. 1 is a schematic illustration of an apparatus employed according to the method of the present invention, wherein a first mode of operation is shown.

Referring now to FIGS. 1–4, each of these figures schematically illustrates a heat exchange system according to a different mode of operation. The system includes a plurality of shell and tube heat exchangers 10*a–j*. Each shell and tube exchanger utilized in the illustrated embodiment is of conventional design and well known to those skilled in the art. Each exchanger includes a tube side and a shell side schematically represented at 12 and 14 respectively. The tube side of each exchanger includes a plurality of tubes through which tube side fluid may flow, and the shell side 14 includes a shell surrounding the tubes which is adapted to receive a shell side fluid therethrough. In operation, shell side fluid flows around the tubes such that heat is exchanged between the tube side fluid and the shell side fluid. As shown, heat exchangers 10*a–j* are connected in series. The system shown in each of FIGS. 1–4 also includes power operated valves 18, 24, 28, 30, 32, 38, 40, 42, 44, 46, 48, 54, 56, 60, 62 and 64. Certain selected valves are either closed or opened according to a selected mode of operation in performance of the present method. In the FIGURES, an open valve is shown in outline form, whereas a closed valve is shown as solid.

As shown, unstabilized and stabilized crude oils are introduced to the illustrated heat exchange system. The unstabilized crude is simply raw crude oil. The stabilized crude is crude oil which has been subjected to fractionation within a fractionation column to strip light hydrocarbons therefrom. This type of process is carried out so that the crude oil can be conveniently stored in tanks maintained at atmospheric pressure. Light hydrocarbons would tend to vaporize and be lost from unstabilized crude stored in such atmospheric conditions. Thus, by stripping the light hydrocarbons from the unstabilized crude, the resulting stabilized crude can be conveniently stored without risk of losing such light hydrocarbons to vaporization. The stabilized crude from fractionation is available at a much higher temperature than the unstabilized crude. The stabilized crude is passed through the illustrated heat exchange system so as to transmit heat to the unstabilized crude. The unstabilized crude is therefore preheated before being passed to the first stage in processing. This first stage in processing is typically one wherein the preheated unstabilized crude is subjected to a desalting process. The desalted crude is then further heated and subjected to fractionation as described above to yield stabilized crude.

A presently preferred embodiment of the present method will now be described beginning with reference to FIG. 1. As noted above, the system shown in FIG. 1 is set to operate according to the first mode of operation. In this mode of operation, valves 18, 24, 28, 30, 32, 38, 40, and 42 are open and valves 44, 46, 48, 54, 56, 60, 62, and 64 are closed. Unstabilized crude is introduced to the heat exchange system via line 16 and valve 18. As used herein, the term "line" denotes a conduit for conducting fluid flow therethrough. The unstabilized crude accordingly flows into line 20 and through valve 24 so as to enter the tube side of heat exchanger 10*a*. The unstabilized crude is then allowed to flow through the tube side of each exchanger in a successive manner. The unstabilized crude exits exchanger 10*j* via line 26, and passes through valve 28 to the desalter. Stabilized crude is introduced to the system via line 29 so as to pass through valve 30 and into the shell side of exchanger 10*j*. Stabilized crude is allowed to pass from the shell side of the exchanger 10*f* into the shell side of exchanger 10*e*. Flow of the stabilized crude then passes through the remaining exchangers so as to exit 10*a* by means of line 34. The stabilized crude then exits the system through line 36 after flowing through open valves 38 and 40. As noted above, this crude is then typically stored in suitable tanks. For the sake of convenience, the direction of flow of the stabilized crude in FIG. 1 will be denoted as forward flow. This first mode of operation continues for a period, preferably about 1 day, before beginning the second mode of operation which will be discussed in reference to FIG. 2.

Figure 2:
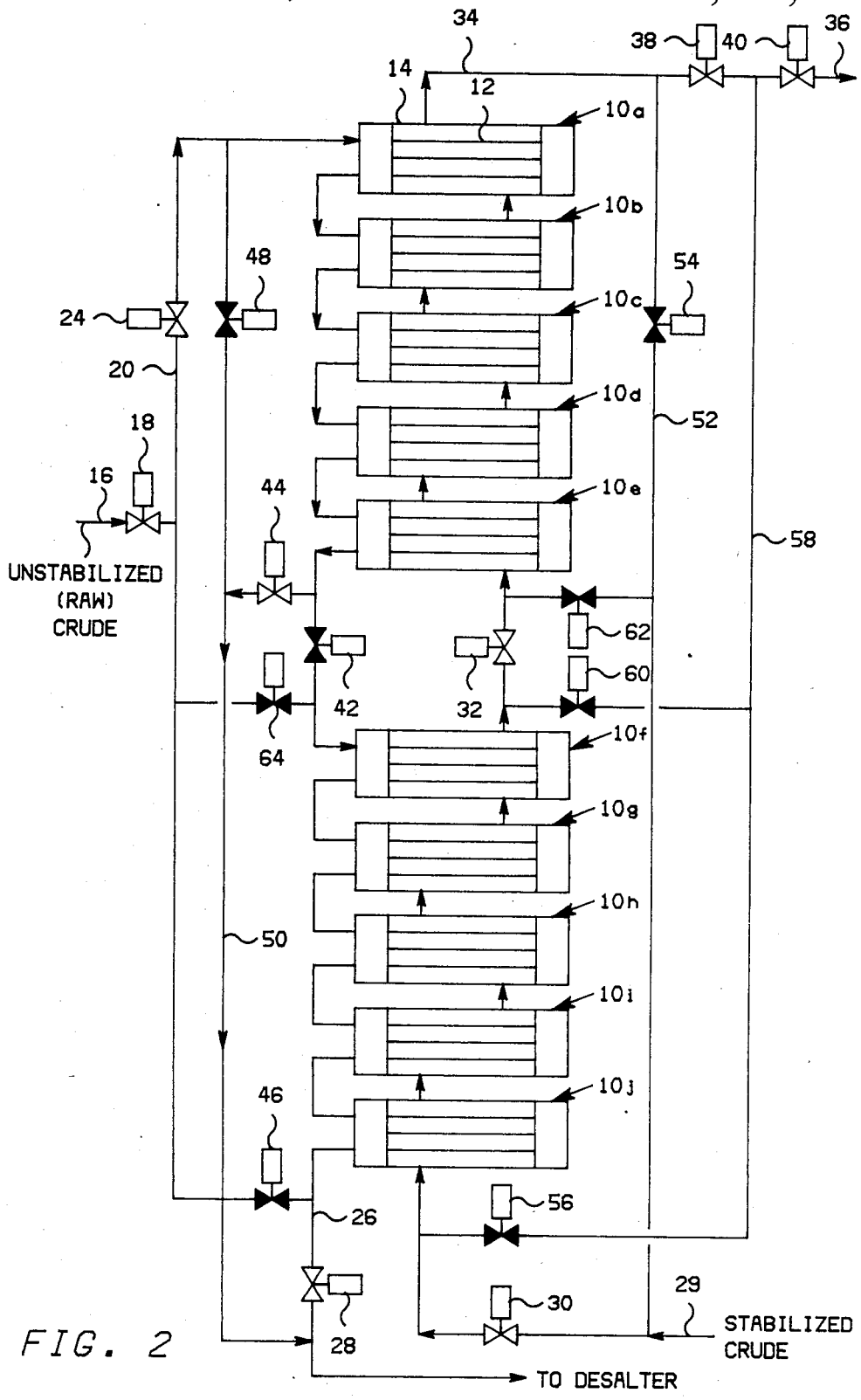
FIG. 2 schematically illustrates the apparatus according to a second mode of operation.

Referring now to FIG. 2, the heat exchange system is shown in a second mode of operation, which begins after completion of the FIG. 1 mode. As shown, valves 18, 24, 28, 30, 32, 38, 40, and 44 are open, whereas valves 42, 46, 48, 54, 56, 60, 62, and 64 are closed. Unstabilized crude is fed into the system through line 16 and valves 18 and 24 so as to enter the tube side of heat exchanger 10*a*. The unstabilized crude then passes through exchangers 10*a–e* in series. In contrast to the FIG. 1 mode, however, valve 42 is closed such that the tube side crude passes through open valve 44 and to the desalter via line 46. Therefore, a flow of unstabilized tube side crude oil is terminated during the FIG. 2 mode to exchangers 10*f–j* so that these exchangers are essentially bypassed. Stabilized crude enters the system through line 29 and valve 30, and then passes through each exchanger in the series in forward flow as in the FIG. 1 mode. Therefore, even though flow of tube side unstabilized crude has been diverted from exchangers 10*f–j*, shell side stabilized crude flow continues through these exchangers so that the temperatures, both shell and tube side, now reach the inlet temperature of the stabilized crude. This temperature is more than sufficient to melt wax and other deposits on the heat exchange surfaces in exchangers 10*f–j*. Moreover, exchanger 10*e* in the group of exchangers 10*a–e* now becomes the hot end of this bank of exchangers. In the FIG. 1 mode, middle exchangers such as 10*d* and 10*e* never reached a temperature sufficient to melt wax and other deposits since these middle exchangers never saw the maximum stabilized crude approach temperature or the maximum unstabilized crude exit temperature. Even if a flow direction reversal was carried out after the FIG. 1 mode of operation middle exchangers such as 10*d–g* would never reach temperatures sufficient to melt wax deposits. As before, stabilized crude exits exchanger 10*a* through line 34 and passes to line 36 via valves 38 and 40. The FIG. 2 mode, therefore, is effectively a cleaning procedure which dewaxes substantially all of the heat exchangers in the series. This cleaning mode is preferably continued for about 1 to about 3 hours in this particular illustrated embodiment. After completion of the FIG. 2 mode of operation, the FIG. 1 mode is typically repeated, followed by repetition of the FIG. 2 mode. A continuous procedure has been described, therefore, wherein a series of heat exchangers can be periodically cleaned. Preferably, the FIG. 2 cleaning mode is carried out about every 24 to 32 hours, the FIG. 1 mode being carried out between performance of the FIG. 2 mode. Even though the cleaning procedure described in connection with FIG. 2 is highly effective, possibly two or three exchangers such as 10*a* and *b* will not be completely dewaxed. Preferably, a flow reversal is carried out to dewax these exchangers, this procedure being described in connection with FIGS. 3 and 4.

Figure 3:
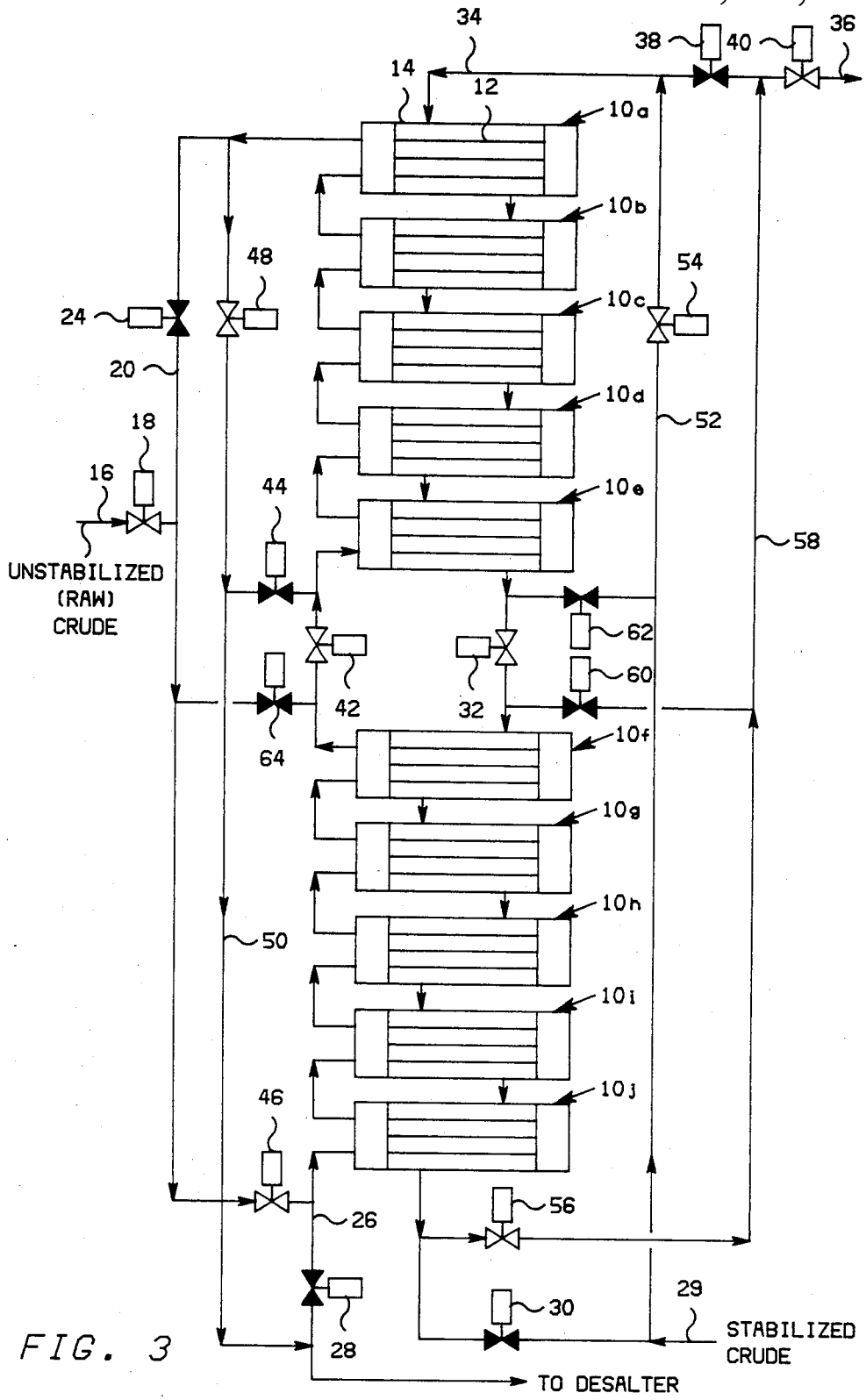
FIG. 3 schematically illustrates the apparatus according to a third mode of operation.

Referring now to FIG. 3, a third mode of operation is shown wherein a flow reversal is carried out. As shown, the direction of flow of the tube side and shell side fluids is reversed from that employed in the FIG. 1 mode of operation. Preferably, the FIG. 3 mode is commenced after about 2 to about 4 days of system operation in the FIGS. 1 and 2 modes. As shown, valves 18, 32, 40, 42, 46, 48, 54, and 56 are open, whereas valves 24, 28, 30, 38, 44, 60, 62, and 64 are closed. Unstabilized crude now flows through open valves 18 and 46 into exchanger 10*j*. The unstabilized crude then passes through the tube side of each exchanger in the series, and exits exchanger 10*a* so as to flow through open valve 48 via line 50 and into the desalter. Stabilized crude is introduced to the shell side of exchanger 10*a* after flowing through line 52 and open valve 54. Accordingly, the stabilized crude passes through the shell side of each exchanger in the series so as to exit exchanger 10*j*. The stabilized crude then passes through valve 56 and through line 58. The stabilized crude exits the system via valve 40 and line 36. This mode is typically continued for about 24 to about 32 hours in a manner similar to that described in the FIG. 1 mode. By reversing the fluid flow as described above, exchanger 10*a* is now on the hot end of the series. Therefore, the exchangers on this end of the series are now receiving hot stabilized crude and are dewaxed accordingly. As noted above, these end exchangers such as 10*a* and 10*b* are not typically dewaxed completely after operation in the FIGS. 1 and 2 modes.

Figure 4:
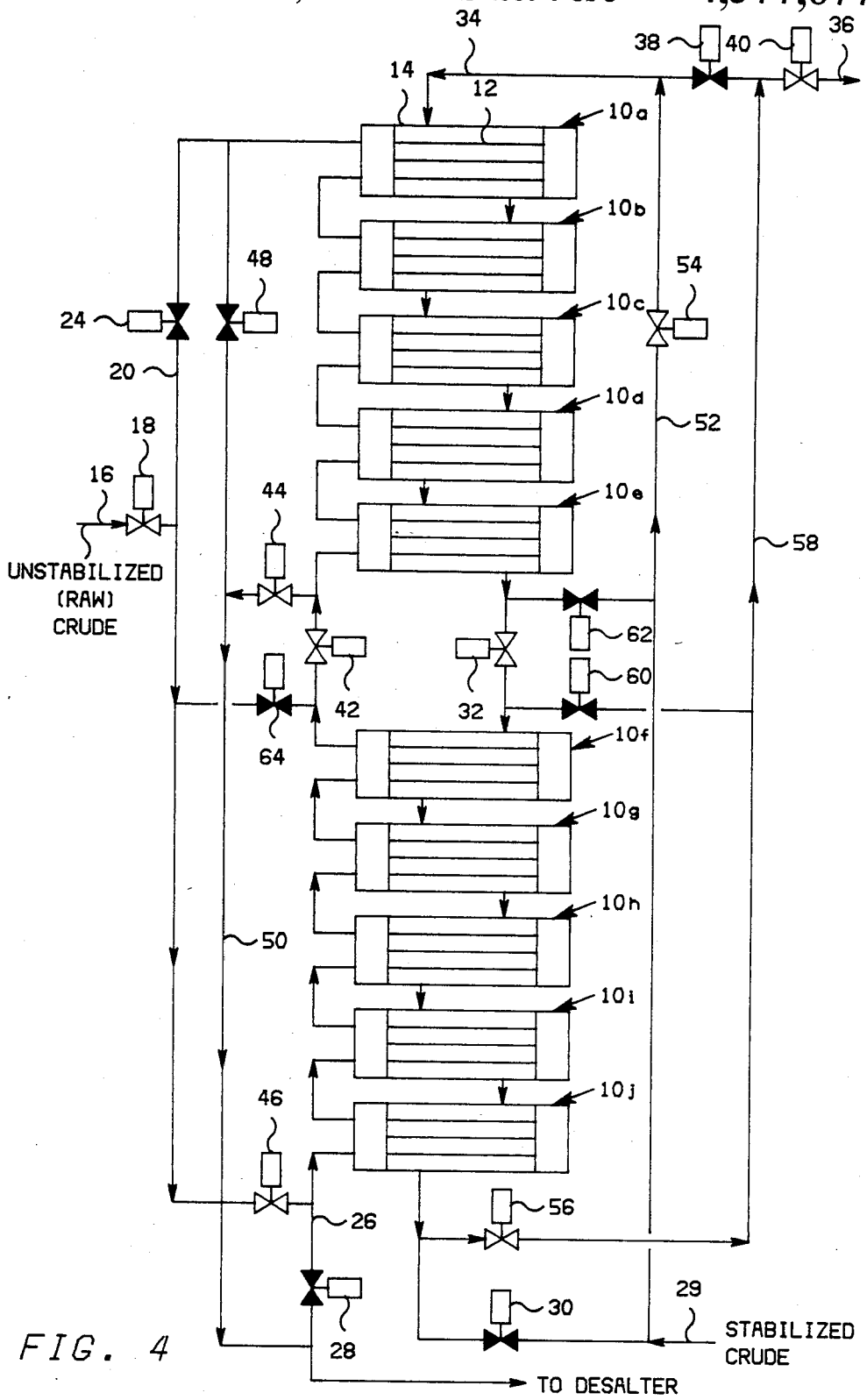
FIG. 4 shows the apparatus according to a fourth mode of operation.

Referring now to FIG. 4, a fourth mode of operation of the system is shown which is commenced after completion of the FIG. 3 mode. As shown, valves 18, 32, 40, 42, 44, 46, 54 and 56 are open, whereas valves 24, 38, 30, 38, 48, 60, 62, and 64 are closed. Unstabilized crude in this mode is passed via valve 18 into line 20 so as to flow through valve 46 into the tube side of exchanger 10*j*. The unstabilized crude passes through the tube side of each exchanger in the group of exchangers 10*f–j*. As noted above, valves 24 and 48 are closed. Thus, flow through exchangers 10*a–e* is prevented such that these exchangers are bypassed. Unstabilized crude flows through open valve 44 accordingly and into line 50 to be carried to the desalter. In a similar manner as discussed in connection with FIG. 2, the FIG. 4 mode is a cleaning mode wherein the group of exchangers 10*a–e* are maintained at a temperature substantially that of the inlet temperature of the stabilized crude so as to effectively dewax these exchangers. Moreover, exchanger 10*f* is now at the hot end of the Group 10*f–j* such that the middle exchangers such as 10*f* and 10*g* are now effectively dewaxed. This fourth mode of operation is continued for about 1 to about 3 hours. The FIG. 3 mode is then typically repeated, followed by repetition of the FIG. 4 cleaning mode. After about 2 to about 4 days of operation in the FIGS. 3 and 4 modes, operation is then switched back to the FIGS. 1 and 2 modes such that another flow reversal is accomplished.

Figure 5:
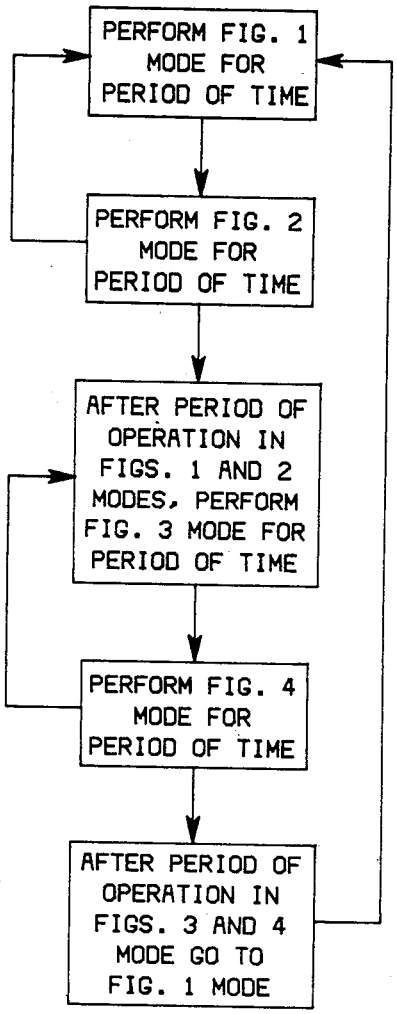
FIG. 5 is a flow chart showing the various steps in a preferred embodiment of the present method.

Referring now to FIG. 5, a flow chart is shown outlining the various steps in the preferred embodiment of the method as discussed above.

The effectiveness of the method may be readily followed during the cleaning modes by following the rise in temperature of the cold stream (e.g., raw crude) as it passes through the exchangers being treated using temperature measuring devices (not shown) at the inlet and outlet for each bank of exchangers. For example, when using the mode of FIG. 2 and assuming the flow rates and inlet temperatures of the two streams are relatively constant, the outlet temperature of the raw or unstabilized crude in line 50 will be relatively low, reflecting the poor heat transfer performance being obtained from the fouled exchangers in the 10*a–e* group or bank of exchangers. Also, the $\Delta T$, the temperature difference between the inlet hot stabilized crude in the line near valve 32 and the raw crude in line 50, will be relatively high for the same reason. As the melting or cleaning mode of FIG. 1 progresses and heat transfer improves the temperature of stream 50 will rise and the $\Delta T$ will decline. Thus, by knowing from experience what these values should be for clean exchangers, one can use these measurements as a guide in determining when the exchangers are clean rather than using the cleaning mode for some arbitrary period of time such as, for example, 24 hours. Since some loss in heat recovery in the system occurs during the cleaning mode, it is desirable to keep the cleaning mode as short as possible. In addition, a full flow mode such as shown in FIGS. 1 or 3 may be allowed to continue until such time that fouling has become severe enough to cause significant economic loss in heat transfer performance. Such loss can be observed from operating temperatures of the exchangers.

A concrete example employing a system as shown in FIGS. 1–4 will now be described which should not be construed to limit the invention in any manner. The system was operated such that each of the cleaning modes of FIGS. 2 and 4 was continued for 1 hour. Such cleaning or dewaxing was performed on a daily basis. A flow reversal was carried out twice weekly. The improved heat recovery, with allowances made for the 1 hour dewaxing procedure during which time less recovery is made, averages approximately 6 BTU for every pound of unstabilized crude processed. With a throughput of approximately 330,000 barrels of unstabilized crude daily, increased heat recovery of approximately 22,500,000 BTU/hr was accomplished. An average mass flow rate of the stabilized crude was maintained at 891,071 lb/hr. Moreover, applying the method of the present invention to the illustrated system can be expected to effect an annual saving well over $500,000. The improved results cited above have been calculated by comparing results obtained with the inventive method to results obtained by operating the system with simple periodic flow reversals.

Thus, there is provided by the present invention a method of operating a heat exchange system wherein the system is periodically cleaned to melt wax and other deposits therein. Cleaning is accomplished without expensive solvents or warming equipment. Also, little operator time is required to implement the cleaning procedure since only valve settings must be changed to convert to cleaning modes. A heat exchange system operated according to the present invention could be adapted for automatic implementation of the method. Finally, as described above, the cleaning mode of the present invention requires only a few hours in which only a portion of the system is effectively taken out of service.

Obviously many modifications and variations of the present invention are possible in light of the above teachings. For example, the invention could be applied to a catalytic reformer unit wherein the incoming feed is heated on one side of an exchanger by the passage of hot reformate on the other side. The invention could be applied to any system wherein heat is exchanged between a hot stream and a cold stream and wherein wax or other deposits present a problem. It is therefore to be understood that within the scope of the appended claims the invention may be practiced otherwise than as specifically described.

What is claimed is:

1. A method of operating a heat exchange system of the type adapted to receive two fluids therethrough such that heat is exchanged between the fluids, wherein the system comprises a plurality of heat exchangers connected in series such that a fluid passed to a first exchanger in the series is passed successively through each exchanger in the series, a portion of the exchangers making up a first group of exchangers and the remainder making up a second group of exchangers, said method comprising the steps:

(a) passing a first fluid and a second fluid through the entire system for a period of time such that heat exchange between the first and second fluids occurs, wherein the first fluid is at a higher temperature than the second fluid upon entering the system, and wherein the first fluid is passed through the first group before being passed to the second group;

(b) terminating flow of second fluid through the first group of exchangers after completion of step (a) while continuous flow of first fluid is maintained through the entire system for a period of time, wherein no other materials are introduced into the system during this step, whereby the system is cleaned.

2. A method as recited in claim 1, wherein each heat exchanger in the heat exchange system is a shell and tube heat exchanger having a tube side for passing tube side fluid therethrough and a shell side for passing shell side fluid therethrough, tube side fluid being one of said first and second fluids and shell side fluid being the other fluid.

3. A method as recited in claim 2, further comprising the step of repeating step (a).

4. A method as recited in claim 3, wherein steps (a) and (b) are repetitively performed such that step (b) is performed at periodic intervals and step (a) is performed between repetitive performances of step (b).

5. A method as recited in claim 4, wherein in steps (a) and (b), first fluid flows through the system in a first direction, said method further comprising the following steps (c) and (d) which are performed after a period of time elapses in carrying out steps (a) and (b), said steps (c) and (d) being performed after steps (a) and (b):

(c) passing the first fluid and the second fluid through the entire system for a period of time;

(d) terminating flow of second fluid through at least a portion of the system after completion of step (c) while continuous flow of first fluid is maintained through the entire system for a period of time;

wherein in steps (c) and (d), first fluid flows in a second direction opposite said first direction.

6. A method as recited in claim 5, wherein the time of duration of each of steps (b) and (d) is from about about 1 to about 3 hours.

7. A method as recited in claim 6, wherein the first fluid is stabilized crude oil and the second fluid is unstabilized crude oil.

* * * * *